US009701452B2

(12) United States Patent
Lackey et al.

(10) Patent No.: US 9,701,452 B2
(45) Date of Patent: Jul. 11, 2017

(54) VENTED STORAGE CONTAINER

(71) Applicants: Robert William Lackey, Hickory, NC (US); David James McNamara, Huntersville, NC (US)

(72) Inventors: Robert William Lackey, Hickory, NC (US); David James McNamara, Huntersville, NC (US)

(73) Assignee: Protect Plus, LLC, Hickory, NC (US)

( * ) Notice: Subject to any disclaimer, the term of this patent is extended or adjusted under 35 U.S.C. 154(b) by 0 days.

(21) Appl. No.: 13/869,568

(22) Filed: Apr. 24, 2013

(65) Prior Publication Data

US 2013/0284739 A1 Oct. 31, 2013

Related U.S. Application Data

(60) Provisional application No. 61/638,646, filed on Apr. 26, 2012, provisional application No. 61/638,636, filed on Apr. 26, 2012.

(51) Int. Cl.
*B65D 51/16* (2006.01)
*B65D 81/20* (2006.01)

(52) U.S. Cl.
CPC ..... *B65D 51/1644* (2013.01); *B65D 81/2038* (2013.01); *B65D 2581/3437* (2013.01)

(58) Field of Classification Search
CPC .... B65D 41/16; B65D 81/2038; B65D 45/32; B65D 51/1683; B65D 77/225; B65D 2543/00092; B65D 2543/00296; B65D 51/1644; B65D 2581/3437; A47G 19/2272
USPC ..... 220/23.83, 203.11, 367.1, 203.16, 231, 220/592.2
See application file for complete search history.

(56) References Cited

U.S. PATENT DOCUMENTS

| | | | | |
|---|---|---|---|---|
| 4,844,263 | A * | 7/1989 | Hadtke | 206/508 |
| 6,035,769 | A * | 3/2000 | Nomura et al. | 99/472 |
| 6,789,393 | B2 * | 9/2004 | Dais et al. | 62/457.6 |
| 2008/0110911 | A1 * | 5/2008 | Chen | 220/788 |
| 2010/0108693 | A1 * | 5/2010 | Zhang et al. | 220/592.2 |
| 2010/0187230 | A1 * | 7/2010 | Beer et al. | 220/89.1 |
| 2010/0270304 | A1 * | 10/2010 | Chen | 220/231 |
| 2010/0307952 | A1 * | 12/2010 | Seline et al. | 206/524.6 |

* cited by examiner

*Primary Examiner* — James N Smalley
(74) *Attorney, Agent, or Firm* — Seth L. Hudson; Clements Bernard Walker, PLLC

(57) ABSTRACT

The present invention provides methods and systems for a vented storage container that includes a container that has an upper mouth-defining structure, a base, and a plurality of walls extending from the base, forming a cavity therein. The lid is fixable to the upper mouth-defining structure, wherein the lid has a top surface and a bottom surface, and at least one hole formed within the lid. A valve is engaged to the lid and covering the at least one hole.

17 Claims, 6 Drawing Sheets

VENTED STORAGE CONTAINER

CROSS REFERENCE TO RELATED PATENT APPLICATIONS

The current application claims the benefit of the earlier priority filing date of the provisional application, Ser. No. 61/638,646 that was filed on Apr. 26, 2012, and provisional application, Ser. No. 61/638,636 that was filed on Apr. 26, 2012.

FIELD OF THE INVENTION

The present invention relates generally to a vented storage container, and more generally relates to a storage container that contains a plurality of venting holes disposed on a lid which are covered by a valve. Additionally, the vented storage container includes a chamber between an internal and an external wall for insulation purposes as well as an area/volume to add performance enhancing features.

BACKGROUND OF THE INVENTION

Storage containers, designed to store food or liquid, generally contain a base that is engaged to a snap-on lid, and the engagement of the snap-on lid to the base forms a relatively airtight seal. Storage containers such as this are well known and may be designed for either multi-use or single use. Generally, the base of these storage containers is clear, allowing a user to view the contents contained within the storage container externally without opening the lid. Alternatively, the base of these storage containers may be opaque or tinted by color for a more appealing look for consumers. The base is a single wall that has no insulation properties.

The prior art storage containers contain a lid that forms the airtight seal with the base, thus preventing the flow of air into and out of the container. Consequently, there is a need in the art for a vented storage container.

The prior art storage containers contain a single wall having a first side and a second side, wherein the first side is an internal side and the second side is an external side. The single wall does not have any insulation properties. Insulation provides both a freshness and safety improvement that allows for contents to keep cool or hot temperatures longer than single wall food containers. Consequently, there is a need for a food storage container to possess insulative properties and have an area/volume within the wall of the container to add an area/volume to add performance enhancing features.

BRIEF SUMMARY OF THE INVENTION

According to an embodiment of the present invention, the present invention includes a vented storage container that contains an upper mouth-defining structure, a base, and a plurality of walls extending from the base, forming a cavity therein. The lid is fixable to the upper mouth-defining structure, wherein the lid has a top surface and a bottom surface, and at least one hole formed within the lid. A valve is engaged to the lid and covering the at least one hole.

According to another embodiment of the present invention, the vented storage container includes a valve has a top side and a bottom side, wherein a shaft extends from the bottom side of the valve, and a bore is centrally located on the lid for receiving the shaft of the valve.

According to yet another embodiment of the present invention, the vented storage container includes a flexible valve that allows passive venting.

According to yet another embodiment of the present invention, the vented storage container includes an interior base and an exterior base that has substantially upright interior walls that extend generally upward from the interior base and substantially upright exterior walls that extend generally upward from the exterior base.

According to yet another embodiment of the present invention, the vented storage container includes an interior base that extends to an outer edge with a first pair and a second pair of opposed interior walls extending upwardly from the interior base.

According to yet another embodiment of the present invention, the vented storage container includes a plurality of holes on the lid.

According to yet another embodiment of the present invention, the vented storage container includes a valve that has a top side and a bottom side, wherein a shaft extends from the bottom side of the valve, and a bore is centrally located on the lid and disposed within a plurality of holes for receiving the shaft of the valve, allowing the valve to entirely cover all of the plurality of holes.

According to yet another embodiment of the present invention, the vented storage container includes a container that has an upper mouth-defining structure, a base, and a plurality of walls extending from the base, forming a cavity therein. A lid is fixable to the upper mouth-defining structure, wherein the lid has a top surface and a bottom surface, and a plurality of holes formed within the lid. A valve is selectively secured to the lid and covers the plurality of holes.

According to yet another embodiment of the present invention, the vented storage container includes a container that has an interior base that extends to an outer edge with a first pair and a second pair of opposed interior walls extending upwardly from the interior base and forming a cavity therein and an upper mouth defining structure. The container has an exterior base that extends to an outer edge with a first pair and second pair of opposed exterior walls extending upwardly from the exterior base. A lid that is fixable to the upper mouth-defining structure, wherein the lid has a top surface and a bottom surface, and a plurality of holes formed within the lid. A valve is selectively secured to the lid and covers the plurality of holes.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
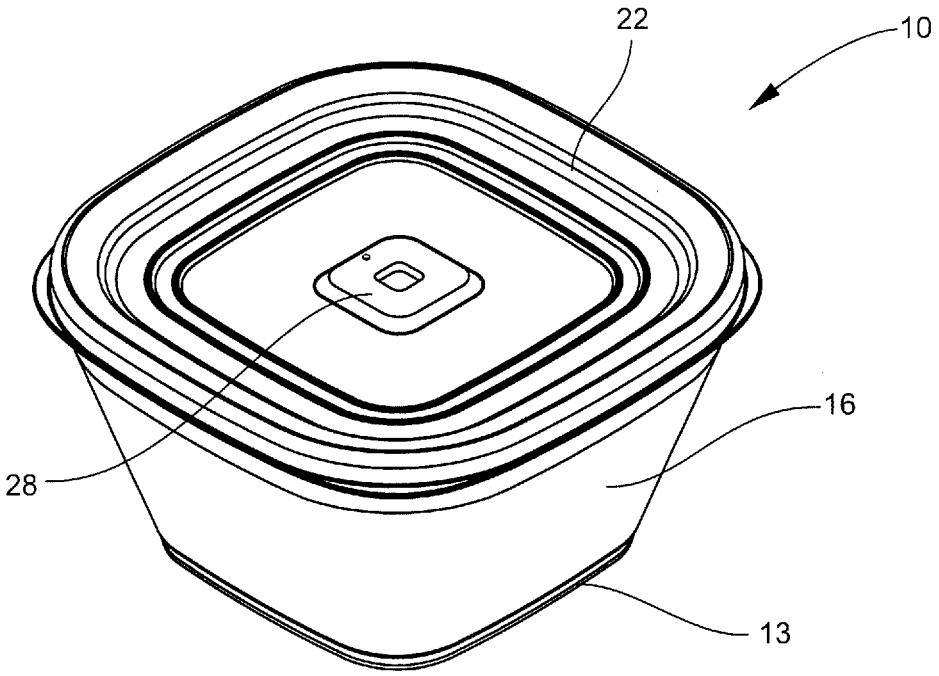
FIG. 1 is a perspective view of the vented storage container.
Figure 3:
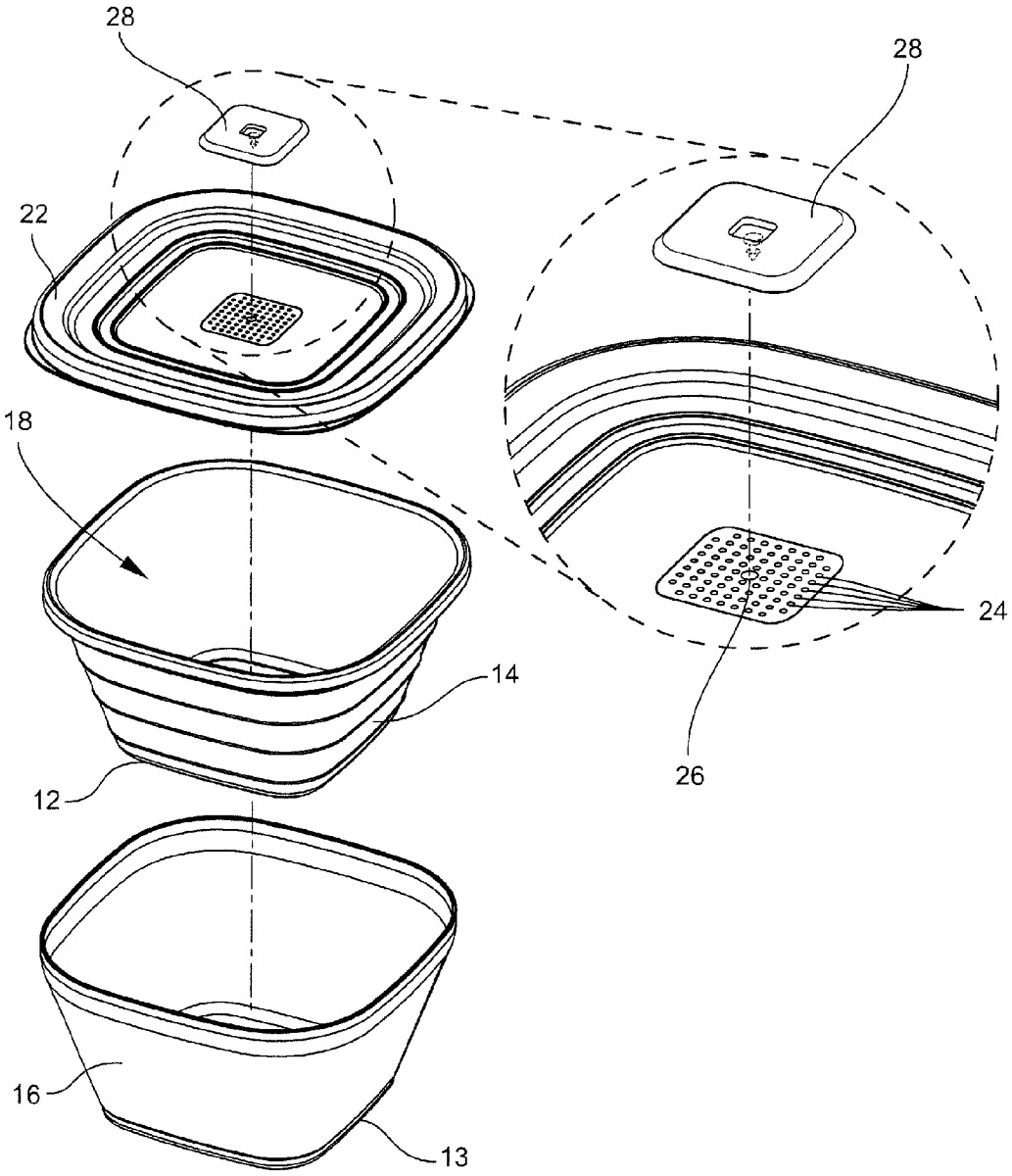
FIG. 3 is an exploded view of the vented storage container.

Referring now specifically to the drawings, a vented storage container is illustrated in FIGS. 1 and 3 and is shown generally at reference numeral 10. The container 10 comprises interior and exterior bases 12, 13 having an upper mouth defining structure and substantially upright interior walls 14 and substantially upright exterior walls 16 that extend generally upward from the respective bases 12, 13. The substantially upright interior walls form a cavity 18 therein. A chamber 20 is located between the interior wall 14 and exterior wall 16. Preferably, the container 10 includes an interior base 12 that extends to an outer edge. First and second pairs of opposed interior walls 14 extend upwardly from the interior base 12. The container 10 also includes an exterior base 13 that extends to an outer edge. First and second pairs of opposed exterior walls 16 extend upwardly from the exterior base 13.

The container 10 also includes a lid 22 that has generally continuous top and bottom surfaces. The lid 22 includes a plurality of holes 24 and a generally centrally located bore 26. In one embodiment illustrated in FIG. 3, the plurality of holes 24 are centrally located at the center of the lid 22. The bore 26 has an opening in the top surface of the lid 22 and extends into the bottom surface of the lid 22.

The interior walls 14 and exterior walls 16 are in a generally spaced apart relationship, forming a chamber 20 therein. The interior walls 14 include an interior side and an exterior side, and the exterior walls 16 include an interior side and an exterior side. Additionally, the interior base 12 and exterior base 13 are in a spaced-apart relationship. The chamber 20 is a void between the exterior side of the interior walls 14 and interior side of the exterior walls 16. The first and second pairs of opposed interior walls 14 and first and second pairs of opposed exterior walls 16 are engaged at the mouth defining structure. In this arrangement, the interior base 12 and first and second pairs of opposed interior walls 14 are suspended over top the exterior base 13 and first and second pairs of opposed exterior walls 16. The interior wall 14 and exterior wall 16 may be engaged to each other by welding (sonic, hot plate weld, high-frequency welding, friction welding, laser welding, and solvent welding) or mechanically assembled.

A valve 28 having a top side and a bottom side may be selectively secured or permanently affixed to the lid 22. The top side of the valve 28 faces away from the interior base 12 and the bottom side of the valve 28 is positioned adjacent the plurality of holes 24 and facing the interior base 12. A shaft 30 has a first end and a second end, whereby the first end is engaged to the bottom side of the valve 28 and extends substantially, perpendicularly away from the valve 28. The second end of the shaft 30 has a frostoconical end. The frostoconical end contains an outwardly extending rim 32 that circumscribes the shaft 30 and has a diameter greater than the shaft 30, forming a shelf thereon. The frostoconical end tapers downward from the shelf of the rim 32. In other words, the diameter of the frostoconical end decreases gradually from the shelf of the rim 32 to the very end of the shaft 30.

Figure 4:
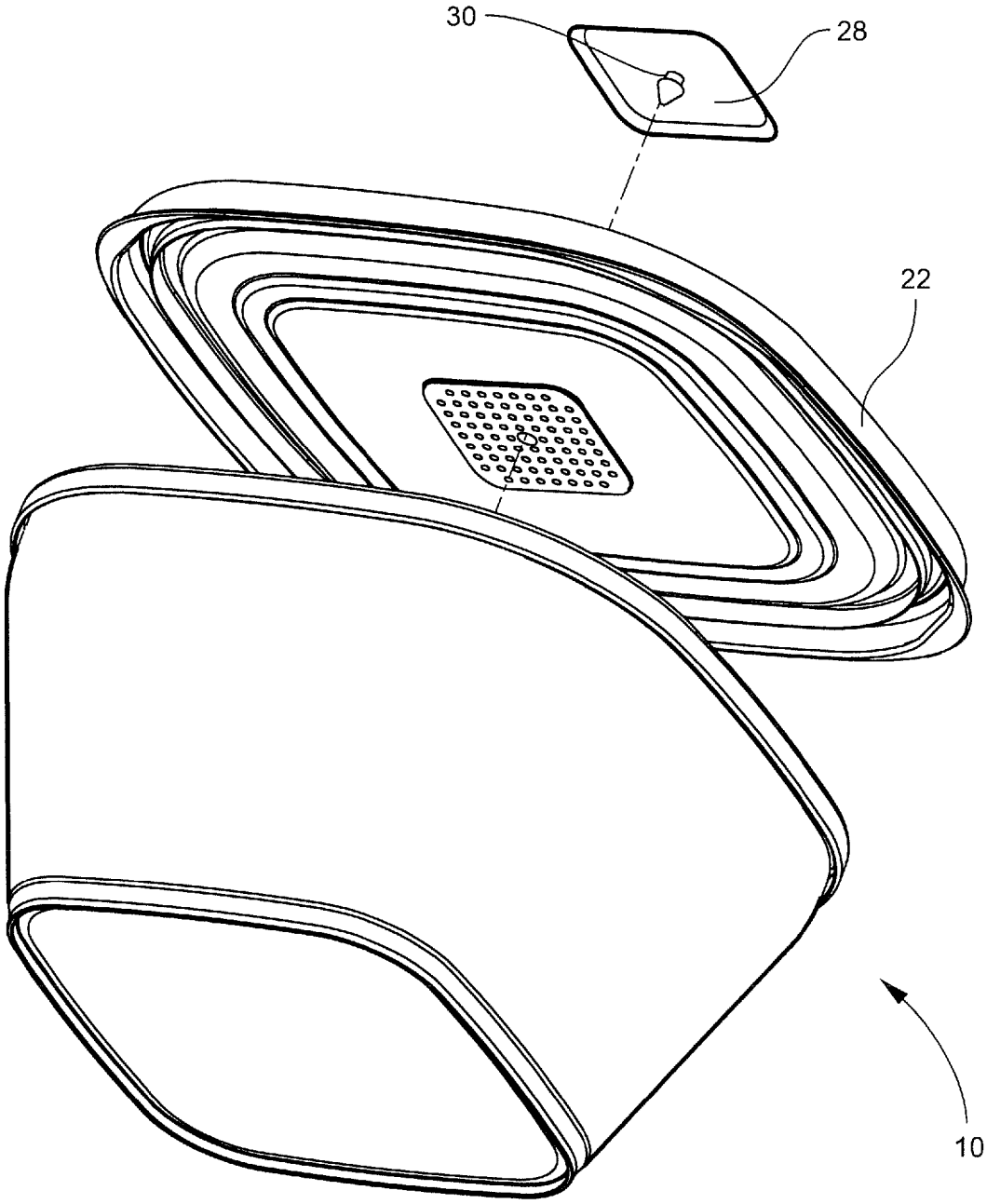
FIG. 4 is a bottom perspective view of the vented storage container.
Figure 5:
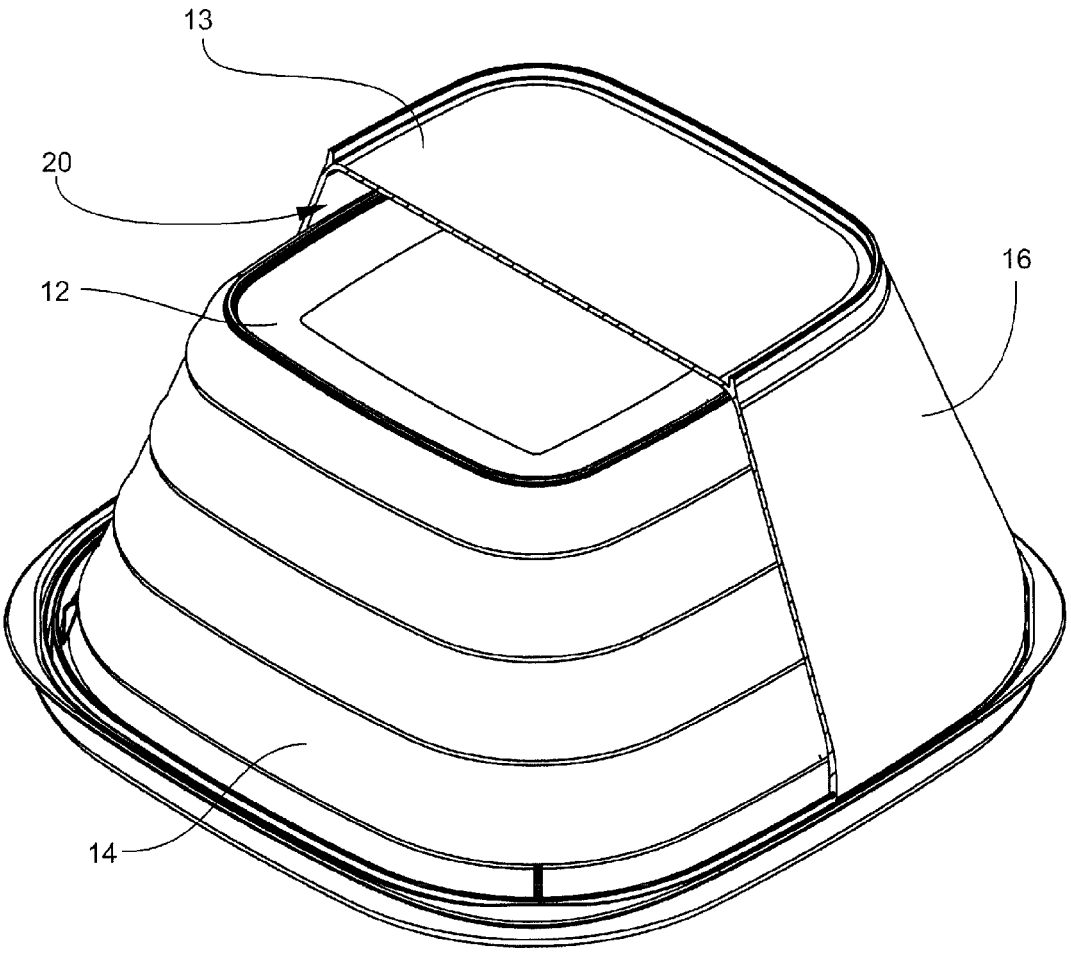
FIG. 5 is a partial bottom cut-away view of the vented storage container.

The bore 26 of the lid 14 is designed and intended to receive the shaft 30 of the valve 28. As illustrated in FIGS. 3 and 4, the frostoconical end of the second end of the shaft 30 is inserted into the bore 26. The frostoconical end passes through to the bottom side of the valve 28, and the bore 26 is positioned along the shaft 30 between the first end and second end. The shelf of the rim 32 is engaged to the underside of the valve, forming a selectively secured arrangement or permanent arrangement. The valve 28 may be positioned within the cavity of the lid 14 by an insert molding process, press-fit, or mechanical fit by automated or hand assembly.

The shelf of the rim 32 engages the bottom surface of the valve 28, thus preventing unwanted and unintended movement of the valve 28. The shelf of the rim 32 maintains the valve 28 in a selectively secured arrangement and prevents movement when the container 10 is turned on its side or upside down. By its very nature, the shaft 30 and rim 32 are composed of silicone and are resiliently flexible, allowing the valve 28 to be easily inserted within the bore 26 by compressing the shaft 30 and rim 32 for forcing through the bore 26. After the shaft 30 and rim 32 are pushed through the bore 26, they return to their original shape and the shelf of the rim 32 prevents the shaft 30 and rim 32 from proceeding back through the bore 26 unintended.

The valve 28 is a vent with optional filtering enhancements that allows for passive venting. The term passive venting is meant to define a valve 28 that allows vapors and/or gases to escape from the container relatively uninhibited. In other words, the container 10 may be used to store liquids or foods, but the valve 28 allows the vapors/gases of the liquid to pass through the valve 28 while containing liquids.

Figure 6:
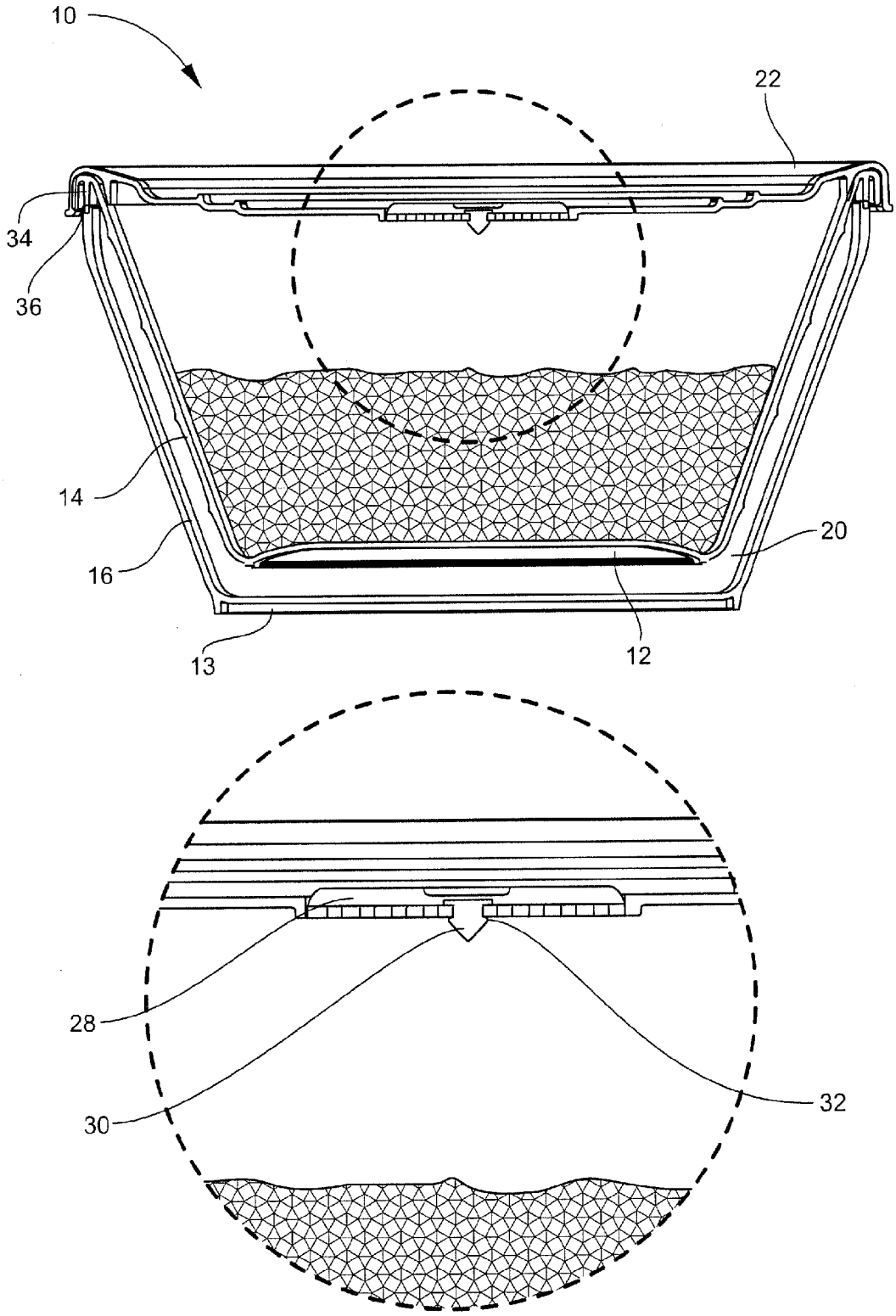
FIG. 6 is an exploded view of the vent of the vented storage container.
Figure 7:
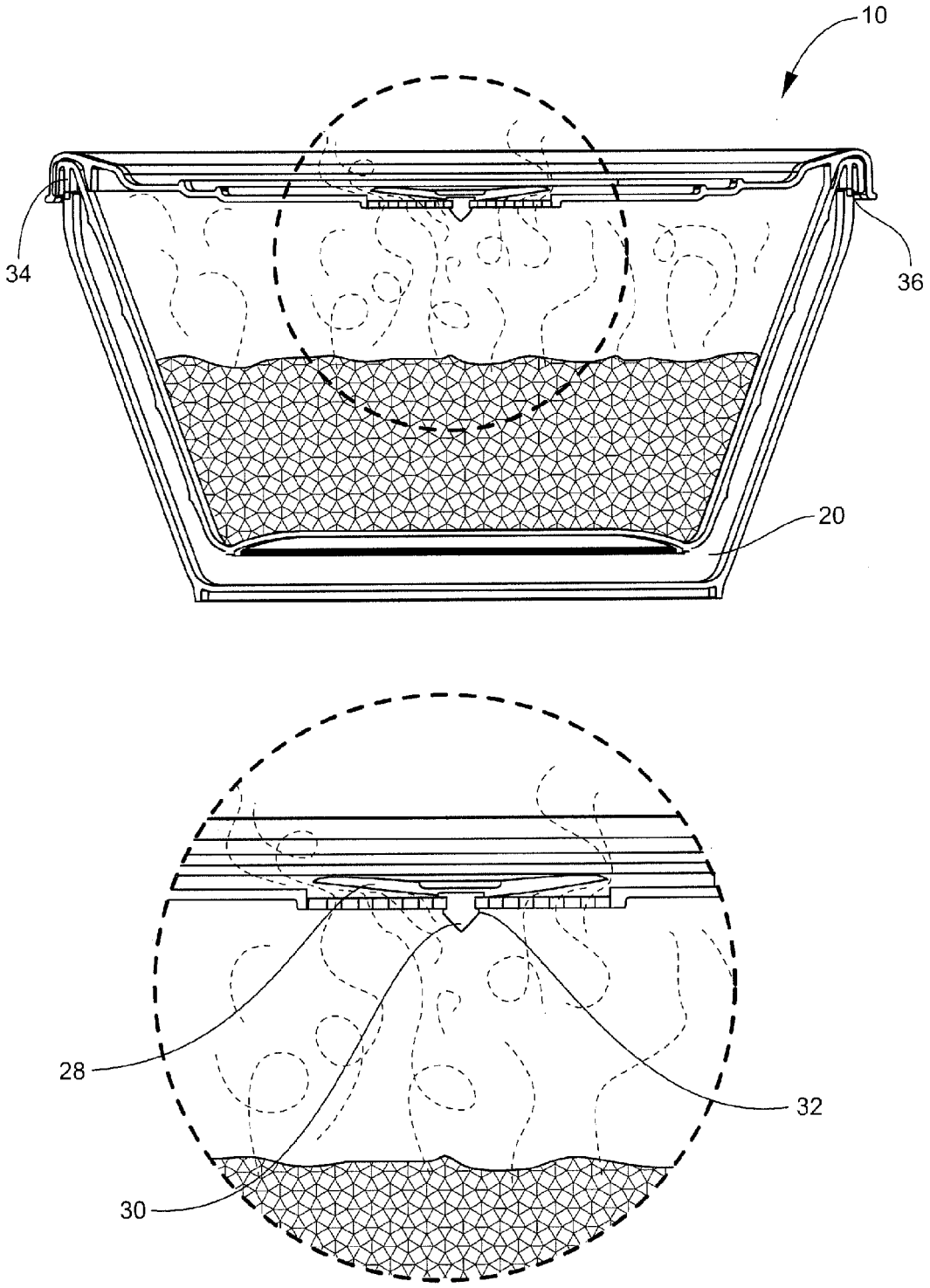
FIG. 7 is an exploded view of the vent of the vented storage container releasing vapor.

As illustrated in FIGS. 3 and 4, the lid 22 contains a plurality of holes 24 that extend from the top surface to the bottom surface of the lid 22. The holes 24 serve as a type of filter that prevents food from compromising or damaging the valve 28. A generally centrally located bore 26 is disposed within the lid 22 and extends from the top surface to the bottom surface. The holes 24 generally surround the bore 26. The plurality of holes 24 are spaced an equal distance apart, thus creating a generally uniform arrangement around the bore 26. However, it should be noted that the holes 24 may be arranged in any arrangement. The holes 24 may be any shape and size for allowing vapor and/or gas to pass therethrough. The vapor and/or gas may pass through holes 24 and valve 28, as illustrated in FIG. 7. The valve 28, as illustrated in FIGS. 1 and 3, may be generally square and have a raised arcuate portion that is positioned overtop and spaced apart from the holes 24 for allowing vapors and/or gases to escape from the holes 24. The vapors and/or gases escape under the exterior regions of the valve 28, while containing liquids therein. The center portion of the valve 28 may contain a centrally located depression that is generally square shaped and the arcuate portion extends outwardly therefrom. The outer edges of the valve 28 extend downwardly from the arcuate portion and engage the lid 22, wherein the valve 28 fully covers the plurality of holes 24 as illustrated in FIG. 6. During use, the outer edges and arcuate portion of the valve 28 flex upwards from the lid 22 for allowing the steam or vapor to escape from the container 10, as shown in FIG. 7. In an alternative embodiment, the valve 28 may be generally circular in shape and contain a raised arcuate portion in close proximity to the outer circumference of the valve 28.

The valve 28 is preferably composed of an FDA grade material. For example, the valve 28 may be composes of silicon or a TPE material.

As illustrated in FIGS. 6 and 7, the interior wall 14 extends over the exterior wall 16. A standing rib 34 is disposed on the external side of the interior wall 14 that engages the top portion of the interior side of the exterior wall 16. The standing rib 34 is engaged to the top portion of the exterior wall 16 by a plastic welding process called hot plate welding. The top portion of the exterior wall 16 may contain a lip 36 that increases the surface area of the top portion of the exterior wall 16. The embodiment as illustrated in FIGS. 6 and 7 is designed to provide an air and water tight seal.

The storage container 10 may also contain at least two handles spaced-apart and on opposing sides of the container 10. The handles are formed from the interior wall 14. In other words, the handles consist of a horizontal interior wall portion that extends from the portion that extends downward along the vertical plane of the exterior wall 16 towards the base 12. The chamber 20 may also be utilized to include performance enhancing features. Additionally, the chamber 20 may be utilized to include decorative elements to the container 10.

The prior art storage containers require a user to actively open a vent to cook foods within the container in a microwave. This is accomplished in the prior art containers by either manually breaking the seal of the lid and base engagement. The present invention offers a water-tight venting material that does not require any action by the user to activate the vent process.

Figure 2:
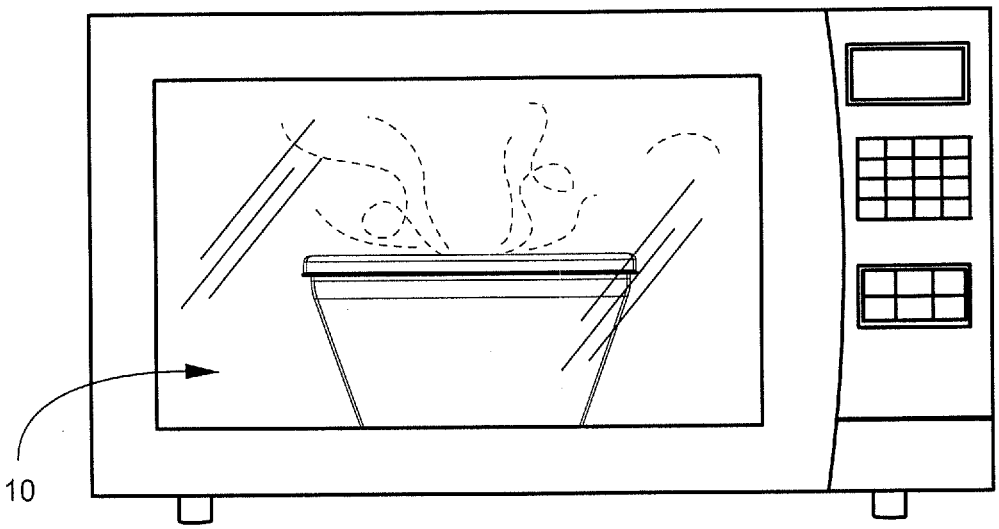
FIG. 2 is a view of the vented storage container in a microwave.

It is preferable that the container 10 and its constituent components, including the valve 28, may be constructed from materials able to withstand a wide range of temperatures. The container 10 should be able to withstand freezing temperatures in a freezer and high temperatures caused by heating in a microwave, thus allowing a user to freeze liquids within the container 10 and allow the user to heat liquids in a microwave. Preferably, the container 10 should be able to withstand a temperature range from about −25° F. (−31.66° C.) to about 212° F. (100° C.), including all points in between. These temperature ranges are the expected temperature ranges that the container 10 will experience during ordinary and intended use. When the container 10 is used in a microwave, as illustrated in FIG. 2, the container 10 is cool to the touch and allows a user to easily remove the container with their hands from the microwave.

The container 10 of the present invention may contain other features that will increase its utility. For example, the base 12 in accordance with the present invention preferably has a cavity large enough for receiving a second container 10 within the cavity. This arrangement allows a second container 10 to sit within the cavity of a first container 10 in a selectively secured arrangement, while saving space. In other words, at least two containers 10 are allowed to be nested together. The cavity of the base 12 may be formed in a number of different ways, including having a flat base, a concave base, and a convex base. The container 10 walls may also extend beyond the base to form a flange and a second cavity that extends below the base of the container 10. The container 10 may contain any number of walls, and the sizes of the walls may vary. For instance, as illustrated in the figures, the walls all contain a substantially similar width. In an alternative embodiment, two opposed walls may have a greater width than the opposing two walls forming a rectangularly shaped storage container.

The container 10, including base 12 and lid 22, may be constructed of a substantially transparent material, such as plastic that would allow a user to view the contents of the container 10 externally. As stated above, the container 10 may alternatively be constructed of an opaque or color-tinted material, such as plastic.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A vented storage device comprising:

a first container that has an interior base that extends to an outer edge with a first pair and a second pair of opposed interior walls extending upwardly from the interior base to a top portion and forming a cavity therein and an upper mouth defining structure;

a second container that has an exterior base that extends to an outer edge with a first pair and second pair of opposed exterior walls extending upwardly to a top portion from the exterior base, and the first pair and second pair of exterior walls have an interior side and exterior side; the first pair and second pair of opposed interior walls extend upwardly to an upper portion that does not contact the first pair and second pair of opposed exterior walls, the upper portion consists of the first pair and second pair of opposed interior walls extending upwardly until it is substantially over top a top portion of the first pair and second pair of opposed exterior walls and then the first pair and second pair of opposed interior walls curves downwardly and adjacent the exterior side of the first pair and second pair of opposed exterior walls without contacting the exterior wall;

a cavity disposed between the interior base and exterior base and the first pair and second pair of interior walls and the first pair and second pair of exterior walls, the first pair and second pair of interior walls contains an interior side and an exterior side with the exterior side containing a plurality of ridges extending into the cavity;

a lid that is fixable to the upper mouth-defining structure, wherein the lid has a top surface and a bottom surface, and a plurality of holes formed within the lid;

a bore centrally located within the lid; and a valve that is engaged to the bore located within the lid containing a raised arcuate portion that is positioned overtop and spaced apart from the plurality of holes.

2. The vented storage device of claim 1, wherein the valve has a top side and a bottom side, wherein a shaft extends from the bottom side of the valve and containing outer edges of the valve that extend downwardly from the arcuate portion and engage the lid.

3. The vented storage device of claim 1, wherein the valve is flexible and allows passive venting.

4. The vented storage device of claim 1, wherein the base comprises an interior base and an exterior base and the plurality of walls comprise substantially upright interior walls that extend generally upward from the interior base and substantially upright exterior walls that extend generally upward from the exterior base.

5. The vented storage device of claim 1, further comprising an interior base that extends to an outer edge with a first pair and a second pair of opposed interior walls extending upwardly from the interior base.

6. The vented storage device of claim 1, wherein the valve is composed of silicone.

7. The vented storage device of claim 1, the valve has a top side and a bottom side, wherein a shaft extends from the bottom side of the valve, and a bore is centrally located on the lid and disposed radially within a plurality of holes for receiving the shaft of the valve, allowing the valve to cover the plurality of holes.

8. A vented storage device comprising:

a first container that has an interior base that extends to an outer edge with a first pair and a second pair of opposed interior walls extending upwardly from the interior base to a top portion and forming a cavity therein and an upper mouth defining structure, each interior wall contains an interior side and an exterior side;

a second container that has an exterior base that extends to an outer edge with a first pair and second pair of opposed exterior walls extending upwardly to a top portion from the exterior base, and the first pair and second pair of exterior walls have an interior side and exterior side; the first pair and second pair of opposed interior walls extend upwardly to an upper portion that does not contact the first pair and second pair of opposed exterior walls, the upper portion consists of the first pair and second pair of opposed interior walls extending upwardly until it is substantially over top a top portion of the first pair and second pair of opposed exterior walls and then the first pair and second pair of opposed interior walls curves downwardly and adjacent the exterior side of the first pair and second pair of opposed exterior wall without contacting the exterior wall;

a standing rib disposed in the vertical direction on the external side of the interior wall at the upper portion that engages the top portion of the exterior wall and engaging the first container to the second container;

a bore centrally located within the lid; and a valve having a top portion and a bottom portion with a depression in the top portion that is selectively secured to the bore located within the lid and containing a raised arcuate portion that is positioned overtop and spaced apart from the plurality of holes and containing outer edges that extend downwardly from the arcuate portion and engage the lid.

9. The vented storage device of claim 8, wherein the valve has a top side and a bottom side, wherein a shaft extends from the bottom side of the valve, and a bore is centrally located on the lid for receiving the shaft of the valve.

10. The vented storage device of claim 8, wherein the valve is flexible and allows passive venting.

11. The vented storage device of claim 8, wherein the base comprises an interior base and an exterior base and the plurality of walls comprise substantially upright interior walls that extend generally upward from the interior base and substantially upright exterior walls that extend generally upward from the exterior base.

12. The vented storage device of claim 8, further comprising an interior base that extends to an outer edge with a first pair and a second pair of opposed interior walls extending upwardly from the interior base.

13. The vented storage device of claim 8, the valve has a top side and a bottom side, wherein a shaft extends from the bottom side of the valve, and a bore is centrally located on the lid and disposed within a plurality of holes for receiving the shaft of the valve, allowing the valve to cover the plurality of holes.

14. A vented storage device comprising:

a first container that has an interior base that extends to an outer edge with a first pair and a second pair of opposed interior walls extending upwardly from the interior base to a top portion and forming a cavity therein and an upper mouth defining structure, each interior wall contains an interior side and an exterior side;

a second container that has an exterior base that extends to an outer edge with a first pair and second pair of opposed exterior walls extending upwardly to a top portion from the exterior base, and the first pair and second pair of exterior walls have an interior side and exterior side; the first pair and second pair of opposed interior walls extend upwardly to an upper portion that does not contact the first pair and second pair of opposed exterior walls, the upper portion is substantially arcuate in cross-section and consists of the first pair and second pair of opposed interior walls extending upwardly until it is substantially over top a top portion of the first pair and second pair of opposed exterior walls and then the first pair and second pair of opposed interior walls curves downwardly and adjacent the exterior side of the first pair and second pair of opposed exterior wall without contacting the exterior wall;

a standing rib disposed in the vertical direction on the external side of the interior wall at the upper portion that engages the top portion of the exterior wall and engaging the first container to the second container;

a lid that is fixable to the upper mouth-defining structure, wherein the lid has a top surface and a bottom surface, and a plurality of holes formed within the lid;

a bore within the lid; and a generally square valve having a top side and a bottom side that is engaged to the lid and the bottom side covers the plurality of holes.

15. The vented storage device of claim 14, wherein the valve has a top side and a bottom side, wherein a shaft extends from the bottom side of the valve, and a bore is centrally located on the lid for receiving the shaft of the valve.

16. The vented storage device of claim 14, wherein the valve is flexible and allows passive venting.

17. The vented storage device of claim 14, wherein the valve has a top side and a bottom side, wherein a shaft extends from the bottom side of the valve, and a bore is centrally located on the lid and disposed within a plurality of holes for receiving the shaft of the valve, allowing the valve to cover all of the plurality of holes.

* * * * *